US010544609B2

(12) United States Patent
Rahilly

(10) Patent No.: US 10,544,609 B2
(45) **Date of Patent: *Jan. 28, 2020**

(54) CAM-OPERATED LATCH ASSEMBLY

(71) Applicant: CAREFUSION 303, INC., San Diego, CA (US)

(72) Inventor: Michael Rahilly, Encinitas, CA (US)

(73) Assignee: CareFusion 303, Inc., San Diego, CA (US)

( * ) Notice: Subject to any disclaimer, the term of this patent is extended or adjusted under 35 U.S.C. 154(b) by 1143 days.

This patent is subject to a terminal disclaimer.

(21) Appl. No.: 14/880,995

(22) Filed: Oct. 12, 2015

(65) Prior Publication Data

US 2016/0032629 A1 Feb. 4, 2016

Related U.S. Application Data

(63) Continuation of application No. 13/482,943, filed on May 29, 2012, now Pat. No. 9,157,261.

(51) Int. Cl.
*E05C 3/12* (2006.01)
*E05B 47/00* (2006.01)
(Continued)

(52) U.S. Cl.
CPC ..... *E05C 3/12* (2013.01); *E05B 47/0012* (2013.01); *E05B 65/46* (2013.01); *E05C 3/24* (2013.01); *E05B 2047/0069* (2013.01); *Y10T 292/108* (2015.04); *Y10T 292/1056* (2015.04); *Y10T 292/1077* (2015.04)

(58) Field of Classification Search
CPC .. E05B 47/0012; E05B 65/46; E05B 63/0056; E05B 81/14; E05B 2047/0069; E05B 65/461–469; E05B 2015/0235; E05B 65/0046; E05B 85/234; E05C 3/12; E05C 3/24; E05C 3/26; E05C 19/06; E05C 19/007; E05C 19/024; Y10T 292/1056; Y10T 292/1077; Y10T 292/292; Y10T 292/108; Y10T 292/1051; Y10T 292/1075; Y10T 292/1082–1085; H02K 7/06; H02K 23/68
USPC ..... 292/1, 201, 216, DIG. 23, 95, 98, 124, 292/224, 197, 198
See application file for complete search history.

(56) References Cited

U.S. PATENT DOCUMENTS 5,715,716 A * 2/1998 Miller et al. ..... 70/303 A
7,000,956 B2 2/2006 Fisher
(Continued)

*Primary Examiner* — Nathan Cumar
(74) *Attorney, Agent, or Firm* — Morgan, Lewis & Bockius LLP

(57) ABSTRACT

A latch assembly is disclosed that has a latch, a locking lever having locked and unlocked positions, and a detent lever having engaged and disengaged positions. The locking lever is configured to secure the latch in the closed position when the locking lever is in the locked position and the detent lever is configured to provide a detent function when the detent lever is in the engaged position. In certain aspects, the latch assembly includes a single motor and cam assembly having three configurations, wherein the locking lever and detent lever are respectively in the unlocked and disengaged positions while in the first configuration, in the unlocked and engaged positions while in the second configuration, and in the locked and engaged positions while in the third configuration.

20 Claims, 13 Drawing Sheets

(51) Int. Cl.
*E05B 65/46* (2017.01)
*E05C 3/24* (2006.01)

(56) References Cited

U.S. PATENT DOCUMENTS

| | | | | |
|---|---|---|---|---|
| 2001/0005080 | A1* | 6/2001 | Inoue | 292/216 |
| 2001/0052705 | A1 | 12/2001 | Fisher | |
| 2003/0067175 | A1* | 4/2003 | Shiota et al. | 292/201 |
| 2006/0103145 | A1* | 5/2006 | Ottolini et al. | 292/216 |
| 2006/0125245 | A1* | 6/2006 | Graute et al. | 292/216 |
| 2008/0073918 | A1* | 3/2008 | Arabia et al. | 292/201 |
| 2009/0295174 | A1* | 12/2009 | Corrales et al. | 292/169.14 |

* cited by examiner

LOCKED/CLOSED

UNLOCKED/CLOSED

LOCKED/OPEN

UNLOCKED/LATCHED/CLOSED

UNLOCKED/LATCHED/OPEN

UNLOCKED/UNLATCHED/OPEN

LOCKED/LATCHED/OPEN

CAM-OPERATED LATCH ASSEMBLY

CROSS-REFERENCE TO RELATED APPLICATIONS

This application is a continuation of U.S. patent application Ser. No. 13/482,943, filed on May 29, 2012, entitled "MULTIFUNCTION LATCH ASSEMBLY," the disclosure of which is incorporated herein by reference in its entirety.

BACKGROUND

Field

The present invention generally relates to controlled-access storage devices and, in particular, controlled-access drawers and doors for storage of medications and medical supplies.

Description of the Related Art

Medications and supplies must be available to nurses and other caregivers at a variety of locations in a hospital, yet must be kept secure such that they are available only to authorized staff. Many hospitals use automatic dispensing machines (ADMs) to maintain a stock of medications or supplies at various points in the hospital, for example a nurse's station. Medications are often stored in securable drawers while supplies are stored in cabinets having multiple compartments each having a securable door. Users identify themselves to the ADM and, if authorized to do so, select which item are to be removed, whereupon the ADM unlocks the drawer or door to allow access to the selected item.

Currently available ADM drawers often are configured to "pop" out horizontally from the ADM a few inches when unlocked, thereby making it easy for the user to identify which drawer contains the desired item as well as making it easy to further open the drawer without an external handle. In certain ADMs, the drawers are not configured to pop open and must be manually opened by the user. Doors, on the other hand, might hit someone if they were to pop open, so doors of ADMs typically have a locking mechanism and a separate detent mechanism such that the door can be unlocked and then the user can open and close and re-open the door as required to remove the necessary items. After the user removes the item and closes the drawer or door, the system must be capable of securing the door or drawer in the closed position.

SUMMARY

It is desirable to be provide a single mechanism that selectively and independently locks and latches a movable door or drawer to simplify the construction and reduce the cost of an ADM. It is further desirable to be able to separately control the locking and latching functions using a single actuator to further reduce cost and increase the reliability of the mechanism.

In certain embodiments, a latch assembly is disclosed that includes a latch having a closed position and an open position. The latch assembly also includes a locking lever having a locked position and an unlocked position, wherein the locking lever is configured to secure the latch in the closed position when the locking lever is in the locked position. The latch assembly also includes a detent lever having an engaged position and a disengaged position, wherein the detent lever is configured to allow the latch to move between the closed and open positions only upon application of at least a certain amount of force to the latch when the detent lever is in the engaged position.

In certain embodiments, a dispensing machine is disclosed that includes a chassis and a movable element coupled to the chassis. The movable element has a closed position and an open position. A housing is coupled to one of the chassis and the movable element and an engagement feature is coupled to the other of the chassis and the movable element. The dispensing machine also includes a latch that is coupled to the housing and has a closed position and an open position. The latch is configured to engage the engagement feature when the latch is in the closed position and the movable element is in the closed position. The dispensing machine also includes a locking lever that is coupled to the housing and has a locked position and an unlocked position. The locking lever is configured to secure the latch in the closed position when the locking lever is in the locked position. The dispensing machine also includes a detent lever that is coupled to the housing and has an engaged position and a disengaged position. The detent lever is configured to allow the latch to move between the closed and open positions only upon application of at least a certain amount of torque to the latch when the detent lever is in the engaged position.

In certain embodiments, a latch assembly is disclosed that includes a housing and a latch coupled to the housing. The latch has a first position and a second position. The latch assembly also includes a latch spring coupled to the latch. The latch spring is configured to urge the latch toward the second position. The latch assembly also includes a locking lever coupled to the housing. The locking lever has a locked position and an unlocked position. The locking lever is configured to secure the latch in the first position when the locking lever is in the locked position. The latch assembly also includes a locking spring coupled to the locking lever. The locking spring is configured to urge the locking lever toward the locked position. The latch assembly also includes a detent lever coupled to the housing. The detent lever has an engaged position and a disengaged position. The detent lever is configured to allow the latch to move between the first and second positions only upon application of at least a certain amount of force to the latch when the detent lever is in the engaged position. The latch assembly also includes a detent spring coupled to the detent lever and configured to urge the detent lever toward the engaged position. The latch assembly also includes a single cam assembly having a first position, a second position, and a third position. The cam assembly is configured to move the locking lever to the unlocked position and move the detent lever to the disengaged position when the cam assembly is in the first position, move the locking lever to the unlocked position and allow the detent lever to move between the engaged and disengaged positions when the cam assembly is in the second position, and allow the locking lever to move between the locked and unlocked positions and allow the detent lever to move between the engaged and disengaged positions when the cam assembly is in the third position. The latch assembly also includes a single motor coupled between the housing and the cam assembly. The motor is configured to selectably move the cam assembly to one of the group of the first position, the second position, and the third position.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1A:
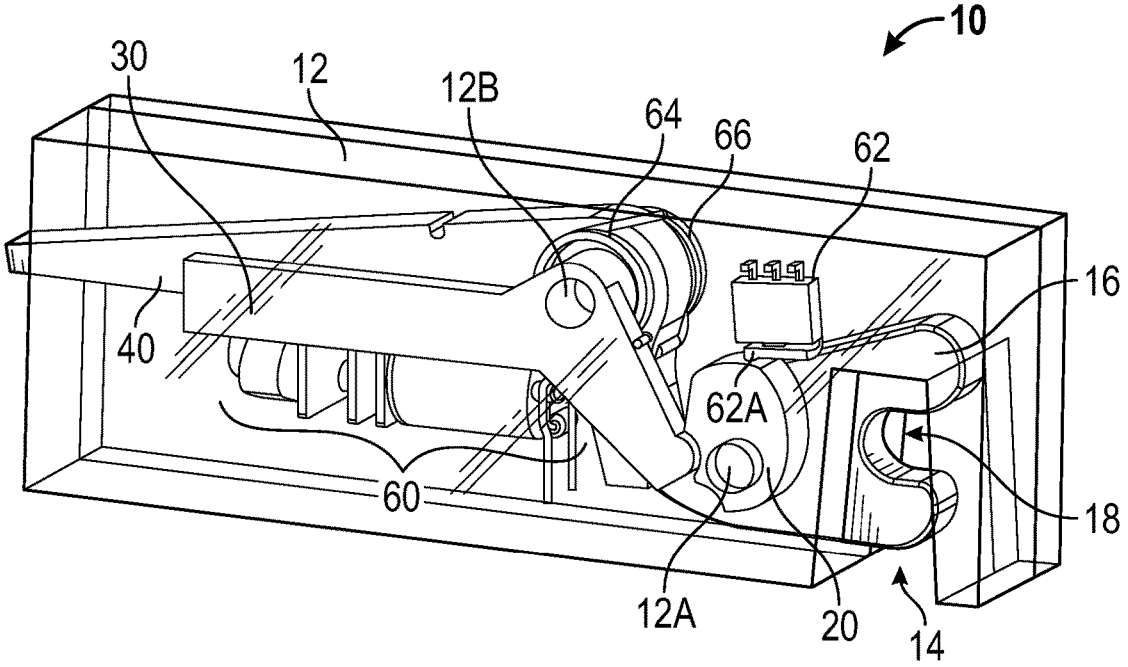
FIGS. 1A-1B are views of an exemplary latch assembly according to certain aspects of the present disclosure.

The following description discloses embodiments of a latch that provides a locking feature that secures a moving element, such as a drawer, in a first position or allows the drawer to move to a second position. The latch also includes the ability to provide a detent function that either holds the drawer in the first position or allows the drawer to move freely between the first and second positions. In certain embodiments, the actuation of both the locking feature and the detent feature are accomplished by a single actuator assembly, such as a motor turning a cam assembly.

While this disclosure explains certain features and aspects of the latch in terms of an ADM used in a hospital environment, it will be apparent to those of skill in the art that embodiments of the disclosed latch may be used in other environments and for other purposes. The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

As used within this disclosure, the term "latch" is defined as a component or assembly either coupled to one of a relatively stationary element or a moving element and configured to engage a corresponding feature of the other of the moving element or the stationary element. When the latch is moved to a first position, the latch secures the feature such that the moving element is restrained from movement relative to the stationary element. A latch may have a second position that allows the feature to engage the latch as the moving element moves with respect to the stationary element. The motion of the latch between the first and second positions may be linear or rotational.

As used within this disclosure, the terms "lock" and "locked" are defined as remaining in a single secured position under the application of forces that are less than the amount of force or torque that will cause damage or breakage of any element associated with the locking function. A device may be considered to be locked while a moving element is not in the secured position, for example when a drawer is still open, if the device is configured to capture and retain the moving element when it first moves to the secured position, for example when the drawer is fully closed.

As used within this disclosure, the term "detent" is defined as a resistance to moving a moving element away from a particular position until at least a certain amount of force or torque is applied to the moving element, whereupon the moving element is permitted to move away from that particular position. The certain amount of force is less than the amount of force or torque that will cause damage or breakage to any element associated with the detent function. The certain amount of force is greater than an amount of force that may be generated by activities not intended to move the moving element, for example bumping a chassis of an ADM in which the moving element is mounted.

As used within this disclosure, the term "spring" is defined as an elastic element that applies a force in proportion to the deformation of the element. Non-limiting examples include coils of metal wire, plastic cantilevers, and compressible blocks of material.

As used within this disclosure, the term "motor" is defined as a device that causes motion in response to the provision of electrical energy. Non-limiting examples of motors include a linear solenoid and a rotational drive that may include one or more of conductive coils and permanent magnets. A motor may also include active or passive elements that control or modulate the provided electrical energy, for example switches, filters, and processors.

As used within this disclosure, the term "freely move" is defined as moving without resistance, beyond friction between elements that are moving with respect to each other, within a defined range of motion.

Figure 1B:
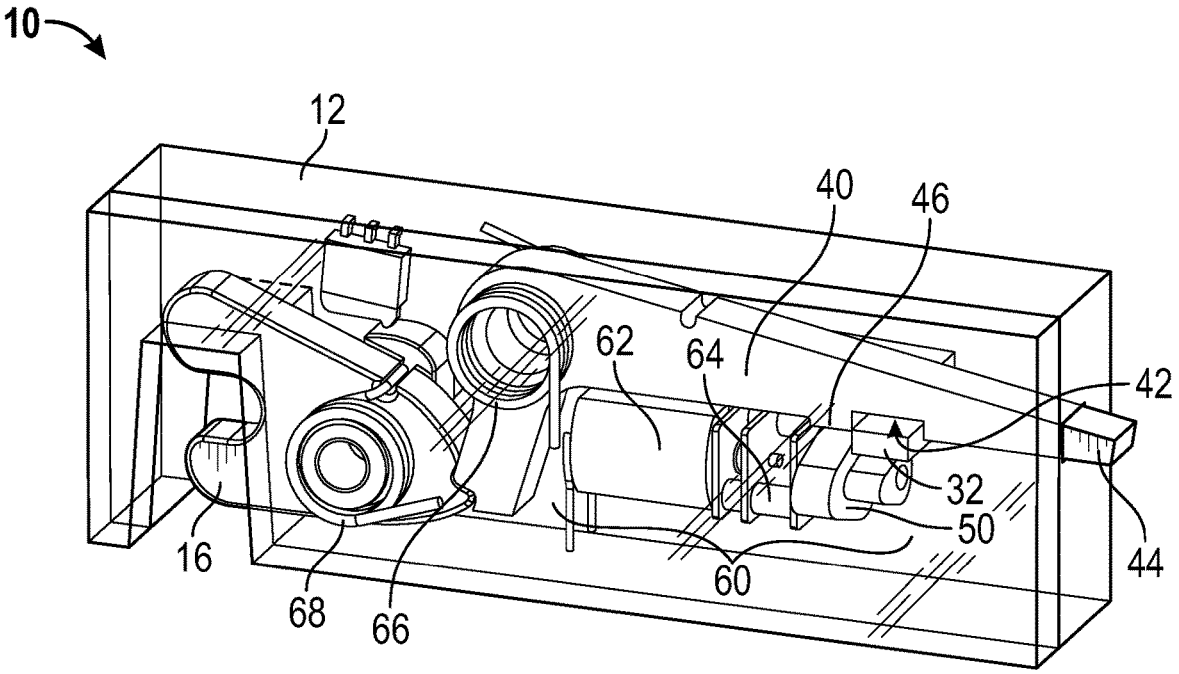

FIGS. 1A-1B are views of an exemplary latch assembly 10 according to certain aspects of the present disclosure. FIG. 1A is a perspective view of a front side of the latch assembly 10 and FIG. 1B is a view of a back side of the same latch assembly 10. The example latch assembly 10 includes a housing 12 with an opening 14 at one end. The housing 12 is shown within this disclosure as semitransparent or omitted to reveal the other components internal to the housing 12. A latch 16 rotates, in this example, about a pivot 12A (not visible in FIGS. 1A-1B) that is coupled to the housing 12. The latch 16 has a slot 18 configured to accept an engagement feature as described in greater detail with respect to FIGS. 2A-2C. The latch 16 moves between a first position, as shown in FIGS. 1A and 1B, and a second position, shown in FIG. 2B.

The latch assembly 10 also includes a locking lever 40 and a detent lever 30 that engage various features of the latch 16. Functions of the locking lever 40 are described in greater detail with respect to FIGS. 7A-7C, and functions of the detent lever 30 are described in greater detail with respect to FIGS. 9A-9C. The locking lever 40 and detent lever 30 are configured to rotate about a pivot 12B (not visible in FIGS. 1A-1B) that is coupled to the housing 12. The locking lever 40 has a locked position, shown in FIGS. 1A and 1B, wherein the locking lever 40 engages the latch 16 and an unlocked position wherein the locking lever 40 does not engage the latch 16. Similarly, the detent lever 30 has an engaged position, shown in FIGS. 1A and 1B, wherein the detent lever 30 engages the latch 16 and a disengaged position wherein the detent lever 30 does not engage the latch 16. In certain embodiments, the detent lever 30 has a right-angle tab 32 that is configured to contact the second cam 54 of the cam assembly 50. In certain embodiments, the detent lever 30 comprises a clearance notch (not visible in FIGS. 1A and 1B) that provides clearance for rotation of the first cam 52 of the cam assembly 50. The locking lever 40 has a notch 42 configured to allow the tab 32 of the detent lever 30 to move upwardly without causing the locking lever 40 to move upwardly, thereby allowing the detent lever 30 and the locking lever 40 to move independently. The locking lever 40 has a step 46 configured to contact the cam assembly 50.

This embodiment of the latch assembly 10 includes a latch spring 68 configured to urge the latch 16 towards the second position, a detent spring 64 configured to urge the detent lever 30 toward the engaged position, and a locking spring 66 configured to urge the locking lever 40 toward the locked position.

The latch assembly 10 also includes an actuator assembly 60 configured to selectably configure the latch assembly 10 to one of three configurations. In the first configuration, the locking lever 40 is in the unlocked position and the detent lever 30 is in the disengaged position. In the second configuration, the locking lever 40 is in the unlocked position and the detent lever 30 is allowed to move between the engaged and disengaged positions. In the third configuration, the locking lever 40 is allowed to move between the locked and unlocked positions and the detent lever 30 is allowed to move between the engaged and disengaged positions. The latch assembly 10 is shown in the third configuration in FIGS. 1A and 1B.

The actuator assembly 60 includes a motor 62, a gear train 64, and a cam assembly 50. The cam assembly 50 is described in greater detail with respect to FIG. 5. In certain embodiments, the motor 62 comprises a processor and sensors (not shown in FIG. 1A or 1B) configured to detect a position of the motor 62, wherein the processor is configured to accept a command to move to one of three positions that configure the latch assembly 10 to one of the three configurations described above and to operate the motor 62 while monitoring the sensors to cause the motor 62 to rotate to the commanded position. In certain embodiments, the sensors are coupled to the output of the gear train 64 so as to detect the position of the cam assembly 50 and enable the processor to drive the motor 62 to cause the cam assembly 50 to move to one of three positions discussed in greater detail with respect to FIGS. 6A-6C.

In this embodiment, the latch assembly 10 also includes a switch 62 that is configured to detect whether the latch 16 is in the first position. In this example, an arm 62A rides against a surface of cam 20 which is configured such that the switch 62 is closed when the latch 16 is rotated into the first position and open when the latch 16 is not in the first position.

Figure 2A:
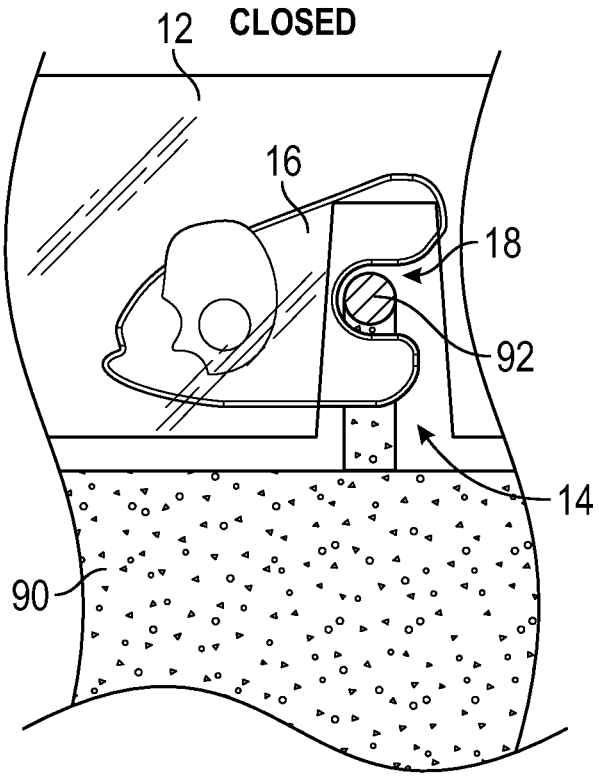
FIGS. 2A-2C are views of various configurations of the latch according to certain aspects of the present disclosure.
Figure 2B:
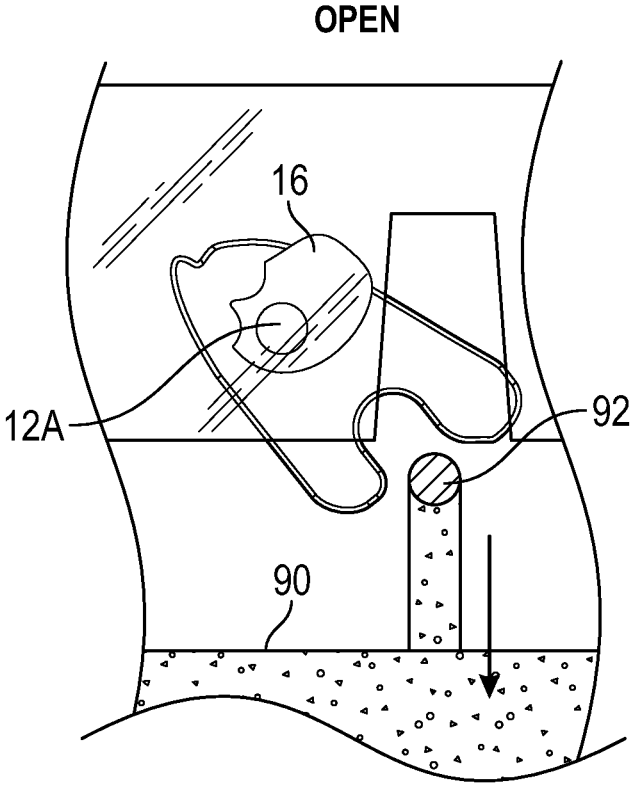
Figure 2C:
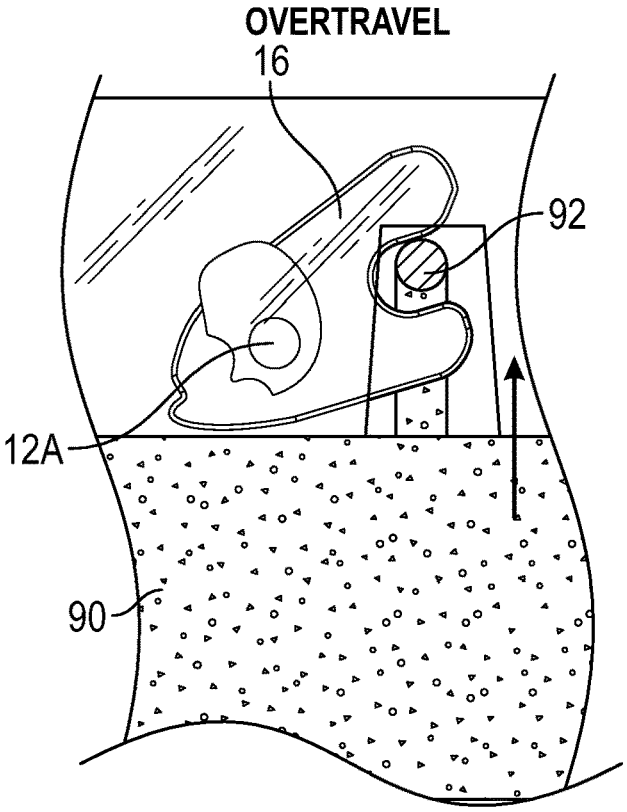

FIGS. 2A-2C are views of various configurations of the latch 16 according to certain aspects of the present disclosure. In FIG. 2A, the latch 16 is in the first or "closed" position and an engagement feature 92 of a moving element 90 is shown as secured within the notch 18. In this example, the moving element 90 is a drawer, such as the drawer 102 of the ADM 100 of FIG. 3, that moves vertically in the view of FIG. 2A between a first or closed position and a second or open position. The engagement feature 92 is a loop attached to the rear of the drawer 90, wherein the engagement features is positioned to enter the opening 14 when the drawer 90 moves toward the latch 16. If the latch 16 is locked in the position shown in FIG. 2A, the drawer 90 cannot be re-opened after the engagement feature 92 is captured by the latch 16.

FIG. 2B shows the latch 16 in the second or "open" position wherein the engagement feature 92 is able to be freely withdrawn from the notch 18 thereby permitting the drawer 90 to open in the direction indicated by the arrow. While the latch 16 remains in the second position shown in FIG. 2B, the drawer 90 can move freely between its first and second positions.

FIG. 2C shows how the latch 16 deflects in a direction past the first position when the drawer 90 is closed and the engagement feature 92 pushes on the notch 18. This "overtravel" position allows the latch 16 to move past the position where the locking lever 40 will engage the latch 16 and thereafter lock the latch 16 in the closed position. The feature 48 of the locking lever 40 that engages the latch 16 and the feature 28 of the latch 16 that is engaged by the feature 48 are visible in FIGS. 7B and 7C.

Figure 3:
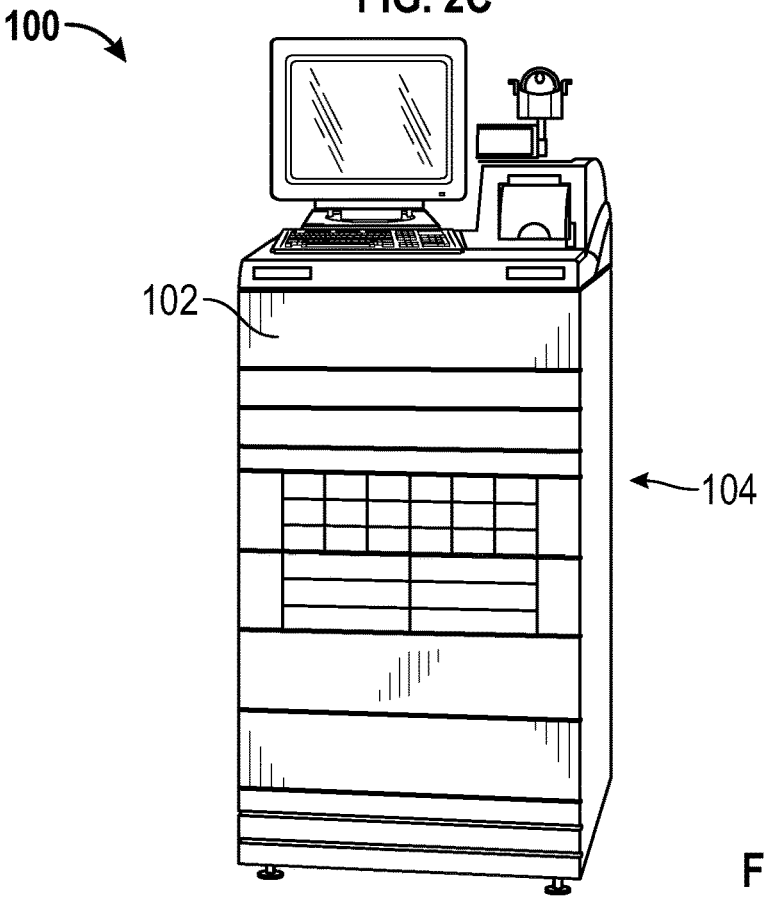
FIG. 3 depicts an exemplary ADM according to certain aspects of the present disclosure.

FIG. 3 depicts an exemplary ADM 100 according to certain aspects of the present disclosure. The ADM 100, in certain embodiments, includes one or more movable elements, for example a drawer 102, that are secured in the chassis 104.

Figure 4:
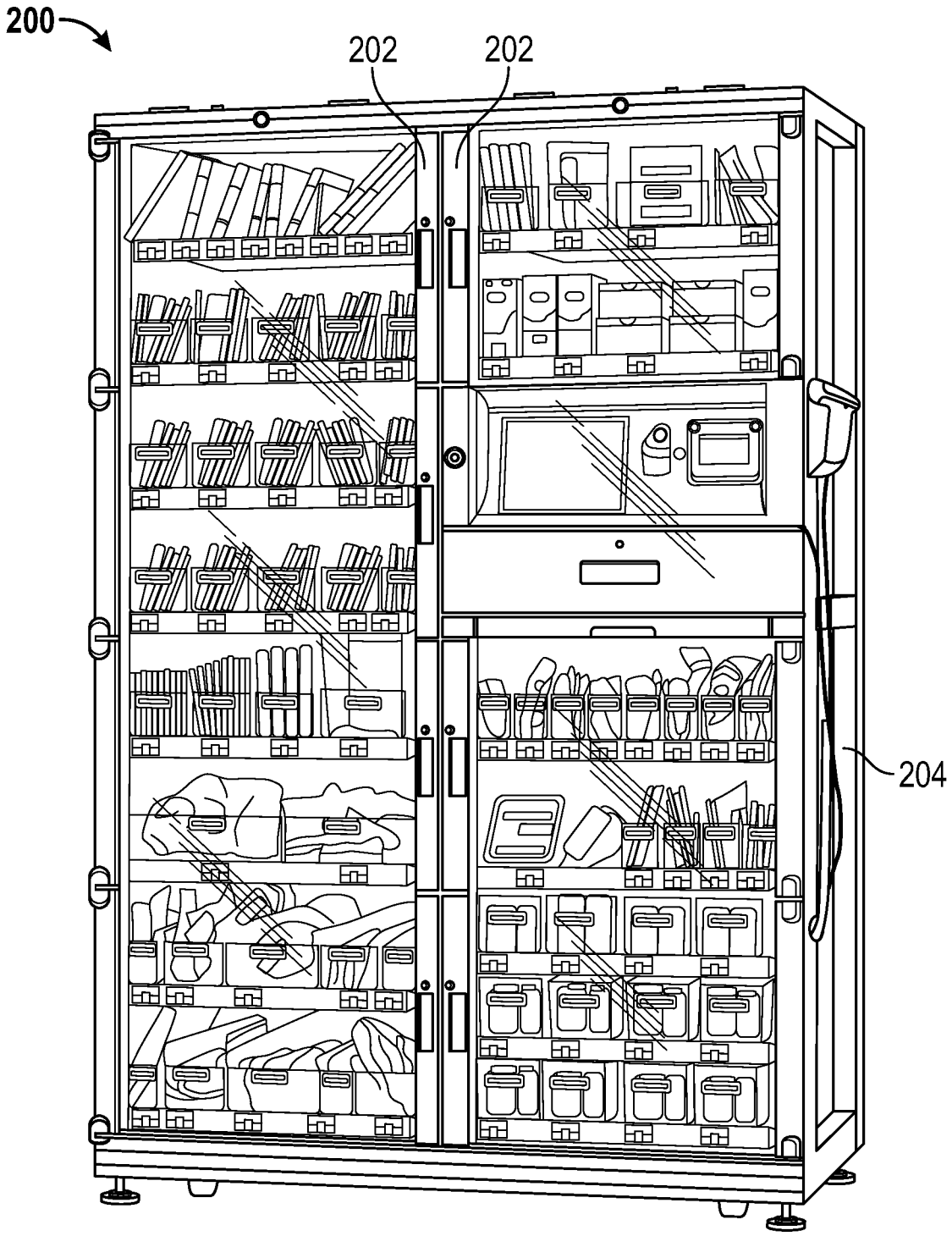
FIG. 4 depicts an exemplary cabinet-style ADM according to certain aspects of the present disclosure.

FIG. 4 depicts an exemplary cabinet-style ADM 200 according to certain aspects of the present disclosure. The ADM 200, in certain embodiments, includes one or more movable elements, for example doors 202, that are secured to the chassis 204.

Figure 5:
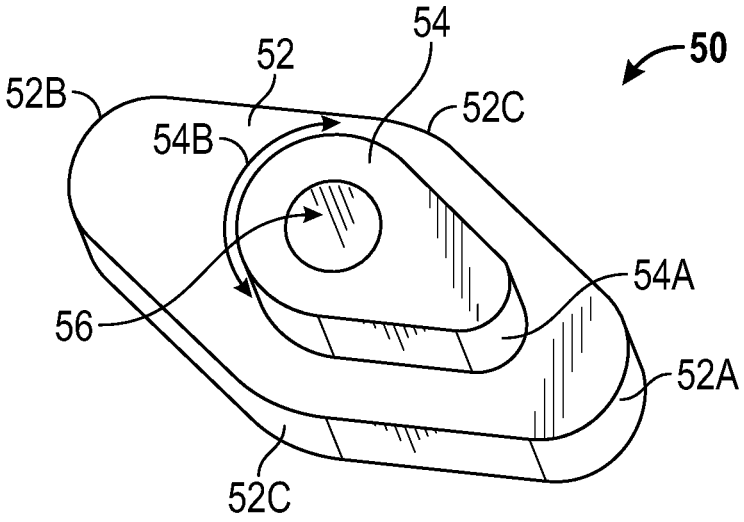
FIG. 5 is a perspective view of the cam assembly according to certain aspects of the present disclosure.

FIG. 5 is a perspective view of the cam assembly 50 according to certain aspects of the present disclosure. In this example, the cam assembly 50 comprises a first cam 52 and a second cam 54 that are coupled together. In the example embodiment of FIGS. 1A and 1B, the cam assembly 50 is arranged such that the first cam 52 is proximate to the step 46 of the locking lever 40 and the second cam 54 is proximate to the tab 32 of the detent lever 30. The first cam 52 comprises at least one first portion 52A, 52B that is configured to move the locking lever 40 to the unlocked position and at least one second portion 52C that is configured to allow the locking lever 40 to move between the locked and unlocked positions. The second cam 54 comprises a first portion 54A that is configured to move the detent lever 30 to the disengaged position and a second portion 54B that is configured to allow the detent lever 30 to move between the engaged and disengaged positions. In this embodiment, the second cam 54 is fixedly coupled to the first cam 52 such that first portion 54A of the second cam 54 is aligned with the portion 52A of the first cam. The other first portion 52B of the first cam 52 is aligned opposite to first portion 52A.

Figure 6A:
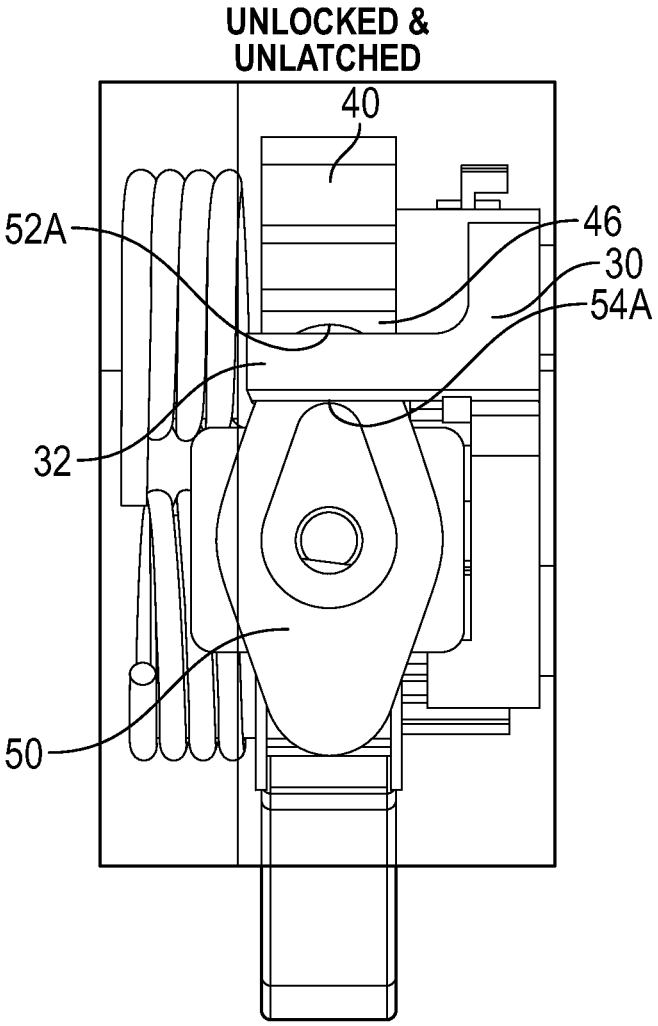
FIGS. 6A-6C are side views of various exemplary configurations of the cam assembly of FIG. 5 within the latch assembly of FIGS. 1A and 1B according to certain aspects of the present disclosure.
Figure 6B:
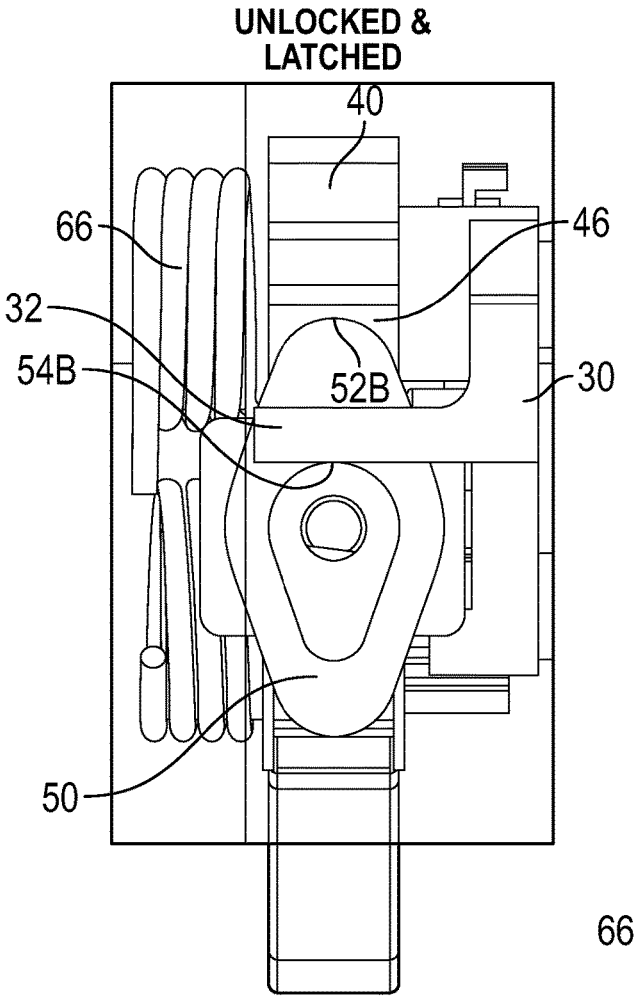
Figure 6C:
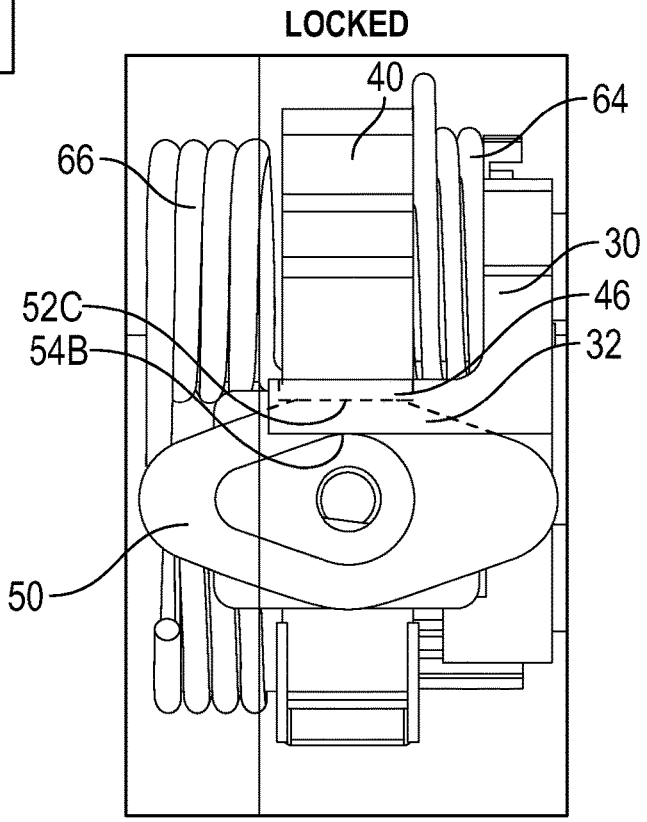

FIGS. 6A-6C are side views of various exemplary configurations of the cam assembly 50 of FIG. 5 within the latch assembly 10 of FIGS. 1A and 1B according to certain aspects of the present disclosure. FIG. 6A depicts the cam assembly 50 in a first orientation that places the latch assembly 10 in a first configuration wherein the first portion 52A of the first cam 52 contacts the step 46 and thereby moves the locking lever 40 to the unlocked position and the first portion 54A of the second cam 54 contacts the tab 32 and thereby moves the detent lever 30 to the disengaged position. This first configuration is referred to as "unlocked and unlatched."

FIG. 6B depicts the cam assembly 50 in a second orientation that places the latch assembly 10 in a second configuration wherein the first portion 52B of the first cam 52 contacts the step 46 and thereby moves the locking lever 40 to the unlocked position and the second portion 54B of the second cam 54 contacts the tab 32 and thereby allows the detent lever 30 to move to the engaged position under the urging of detent spring 64 (not shown in FIG. 6B). As the tab 32 can move away from the cam assembly 50 and rise into the notch 42 (visible in FIG. 1B), the detent lever 30 can move between the engaged and disengaged positions with the cam assembly 50 in this orientation. This second configuration is referred to as "unlocked and latched."

FIG. 6C depicts the cam assembly 50 in a third orientation that places the latch assembly 10 in a third configuration wherein one of the second portions 52C of the first cam 52 contacts the step 46 and thereby allows the locking lever 40 to move to the locked position under the urging of locking spring 66. The second portion 54B of the second cam 54 contacts the tab 32 and thereby allows the detent lever 30 to move to the engaged position under the urging of detent spring 64. As the tab 32 can move away from the cam assembly 50 and rise into the notch 42 and the locking lever 40 can move away from the cam assembly 50 and detent lever 30, the locking lever 40 is allowed to move between the locked and unlocked positions and the detent lever 30 is allowed to move between the engaged and disengaged positions when the latch assembly 10 is in the third configuration. This third configuration is referred to as "locked."

Figure 7A:
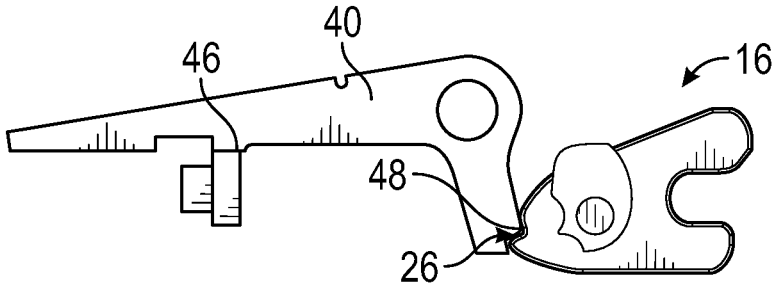
FIGS. 7A-7C depict various configurations of the locking lever according to certain aspects of the present disclosure.
Figure 7B:
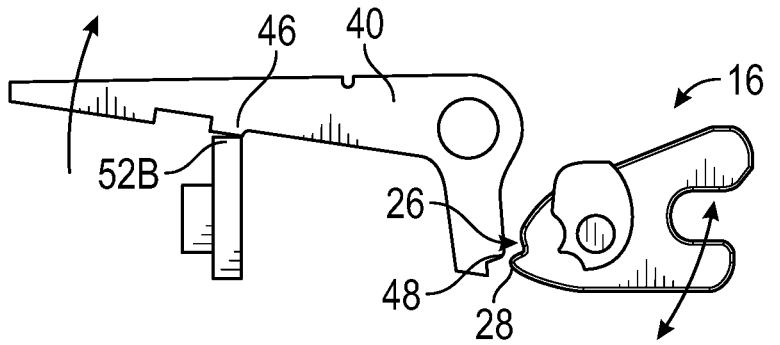
Figure 7C:
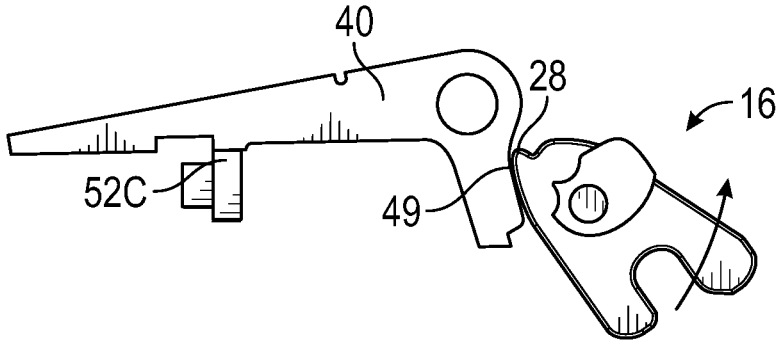
Figure 8A:
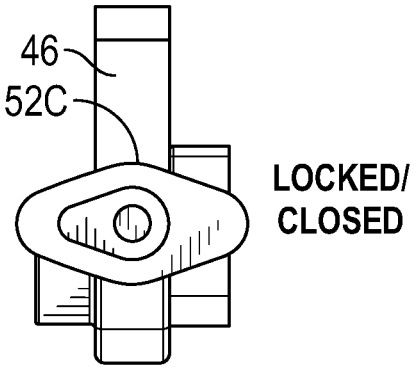
FIGS. 8A-8C depict various configurations of the cam assembly that correspond with the configurations of the locking lever shown in FIGS. 7A-7C according to certain aspects of the present disclosure.

FIGS. 7A-7C depict various configurations of the locking lever 40 according to certain aspects of the present disclosure. In FIG. 7A, the cam assembly 50 is in the third orientation, as shown in FIG. 8A, and the locking lever 40 is shown in the locked position. It can be seen how the tip 48 of the locking lever 40 engages the notch 26 of the latch 16 so as to prevent the latch 16 from rotating to the open position shown in FIG. 2B.

Figure 8B:
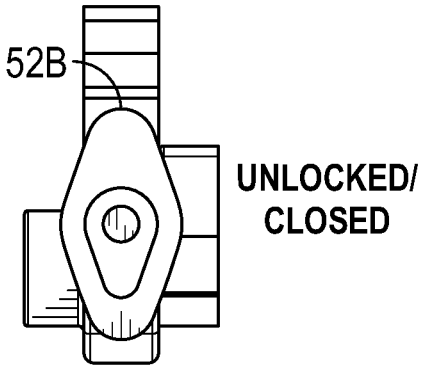

In FIG. 7B, the cam assembly 50 is in the second orientation, as shown in FIG. 8B, and the locking lever 40 is shown in the unlocked position. It can be seen how the tip 48 of the locking lever 40 has retracted from the notch 26 of the latch 16 thereby allowing the latch 16 to rotate between the closed position shown in FIG. 7B and the open position shown in FIG. 2B, as indicated by the double-ended arrow.

Figure 8C:
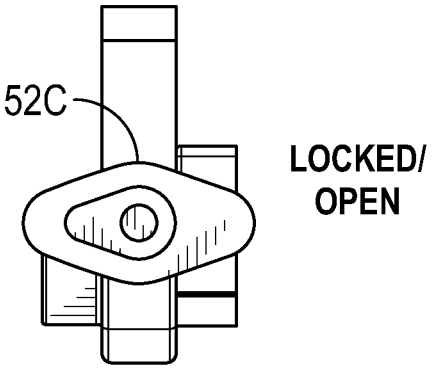

FIG. 7C depicts the locking lever 40 and latch 16 after the latch 16 has moved to the open position and the cam assembly 50 has then moved to the first orientation, as shown in FIG. 8C. This configuration is referred to as "locked and open" as the cam assembly 50 is in the "locked" configuration while the latch 16 is still in the open position of FIG. 2B. The locking lever 40 has attempted to return to the locked position of FIG. 7A under the urging of locking spring 66 (not shown in FIG. 7C) but is blocked from reaching the closed position when the surface 49 of the locking lever 40 contacts the tip 28 of latch 16. The locking lever 40 is held with the surface 49 in contact with tip 28 by the locking spring 66. When the latch 16 returns to or past the locked position, as shown in FIG. 2C, the locking lever 40 will be able to complete the return to the locked position when the tip 48 reengages the notch 26 as shown in FIG. 7A. Thus, the configuration shown in FIGS. 7C and 8C allows an open latch 16 to return to the closed position but not to re-open afterwards, as indicated by the single-ended arrow.

FIGS. 8A-8C depict various configurations of the cam assembly 50 that correspond with the configurations of the locking lever 40 shown in FIGS. 7A-7C according to certain aspects of the present disclosure. The labels adjacent to each of FIGS. 8A-8C indicate the configuration of the cam assembly 50 shown in FIGS. 8A-8C and the latch 16 as shown in the corresponding FIGS. 7A-7C. In certain embodiments, the first cam 52 is symmetrical and the orientation of the cam assembly 50 could be rotated 180 degrees and provide the same displacement of the locking lever 40. For example, in FIG. 8B, the cam assembly 50 could be rotated 180 degrees such that first portion 52A of first cam 52 was in contact with the step 46 instead of first portion 52B and the position of locking lever 40 would be the same.

Figure 9A:
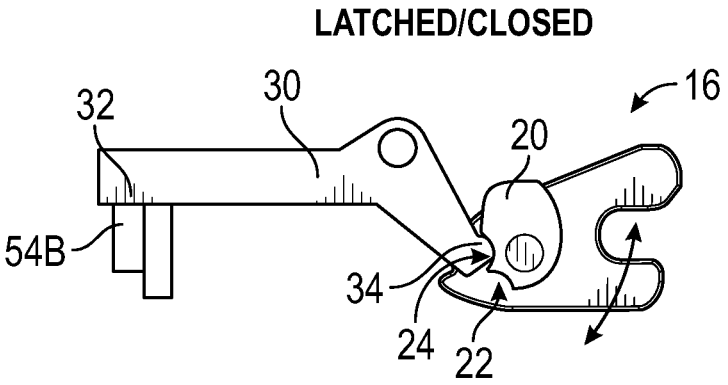
FIGS. 9A-9C depict various configurations of the detent lever according to certain aspects of the present disclosure.
Figure 9B:
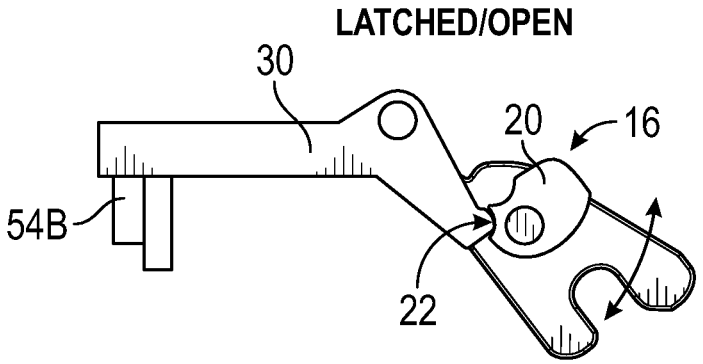
Figure 9C:
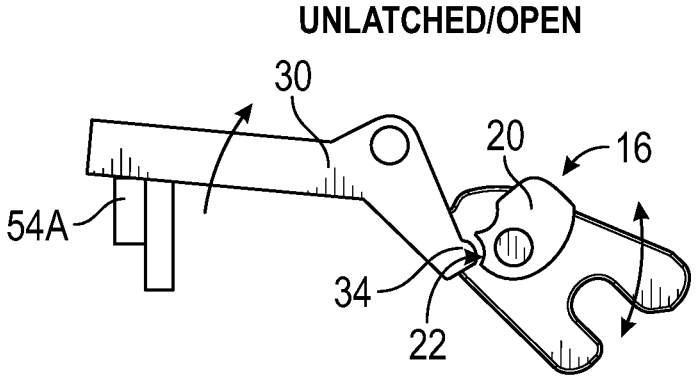
Figure 10A:
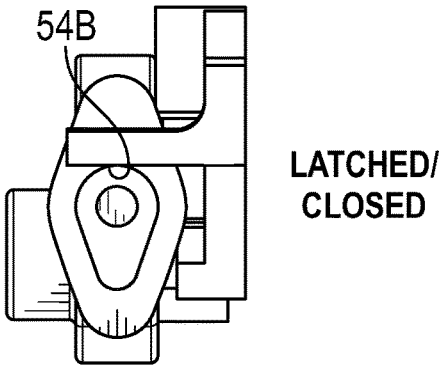
FIGS. 10A-10B depict various configurations of the cam assembly that correspond with the configurations of the detent lever shown in FIGS. 9A-9C according to certain aspects of the present disclosure.

FIGS. 9A-9C depict various configurations of the detent lever according to certain aspects of the present disclosure. In FIG. 9A, the cam assembly 50 is in the second orientation, as shown in FIG. 10A, and the detent lever 30 is shown in the engaged position. It can be seen how the tip 34 of the detent lever 30 engages a first notch 24 of the second cam 20 of latch 16 so as to prevent the latch 16 from rotating to the open position shown in FIG. 2B unless at least a certain amount of force to the latch 16, thereby overcoming the torque applied by detent spring 64 and forcing the detent lever 30 to move away from the engaged position.

FIG. 9B depicts the latch 16 rotated to the open position with the tip 34 of the detent lever 30 engaged with a second notch 22 of the second cam 20 of latch 16. In certain embodiments, the notches 22 and 24 are generally identical such that the force required to move the latch 16 from the closed position to the open position, i.e. moving the tip 34 from notch 24 to notch 22, is approximately the same as the force required to move the latch 16 from the open position to the closed position. The latch 16 can move between the positions shown in FIGS. 9A and 9B upon application of at least the certain amount of force, as indicated by the double-ended arrows in FIGS. 9A and 9B. In certain embodiments, the certain amount of force can be predetermined.

Figure 10B:
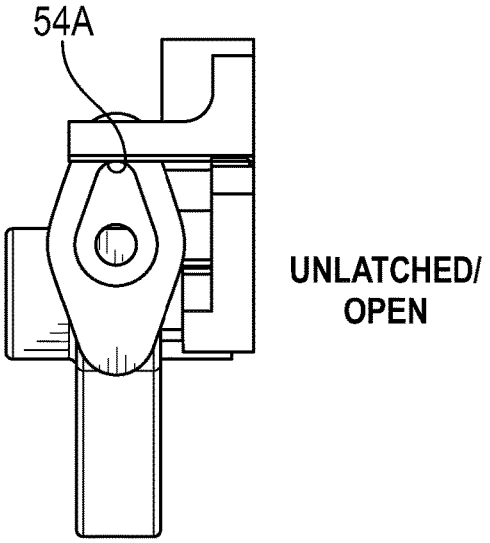

FIG. 9C depicts the detent lever 30 in the disengaged position under the urging of the cam assembly 50 in the first orientation shown in FIG. 10B. With the tip 34 removed from the notches 22 and 24, the latch 16 can freely move between the open and closed positions, as indicated by the double-ended arrow. While the latch 16 can move between the open and closed positions with the cam assembly 50 in any orientation, the latch 16 moves freely when the detent lever 30 is disengaged, as shown in FIG. 9C, and moves only when the detent lever 30 is engaged when at least a certain amount of force is applied to the latch 16, for example by sliding the moving assembly 90 of FIGS. 2A-2C toward or away from the latch 16.

FIGS. 10A-10B depict various configurations of the cam assembly 50 that correspond with the configurations of the detent lever 30 shown in FIGS. 9A-9C according to certain aspects of the present disclosure. FIG. 10A shows the second portion 54B of the cam assembly 50 in contact with the tab 32, which corresponds to both FIGS. 9A and 9B. FIG. 10B shows the cam assembly 50 rotated to the first orientation with the first portion 54A in contact with tab 32, which corresponds to FIG. 9C.

FIGS. 11A-11E depict various configurations of the locking lever 40, detent lever 30, latch 16, and cam assembly 50 according to certain aspects of the present disclosure. The positions shown in FIGS. 11A-11E are combinations of FIGS. 7A-7C and 9A-9C. In the "locked/latched/closed" configuration of FIG. 11A, which corresponds to the orientation of cam assembly 50 shown in FIG. 12A, the latch 16 is in the closed position and the locking lever 40 is retaining the lever 16 in the closed position. The detent lever 30 is in the engaged position, although this has no effect when the locking lever 40 is retaining the latch 16 in the closed position.

Figure 11A:
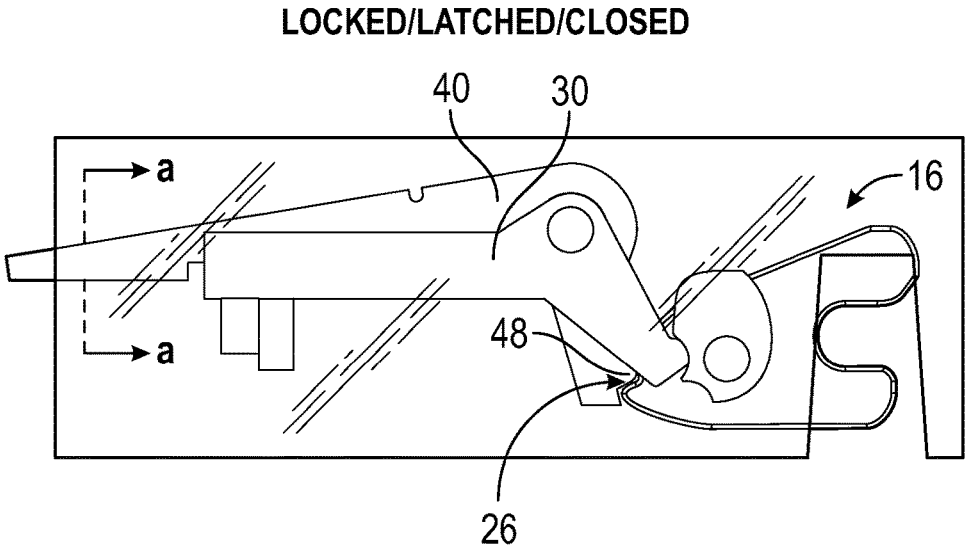
FIGS. 11A-11E depict various configurations of the locking lever, detent lever, latch, and cam assembly according to certain aspects of the present disclosure.
Figure 11B:
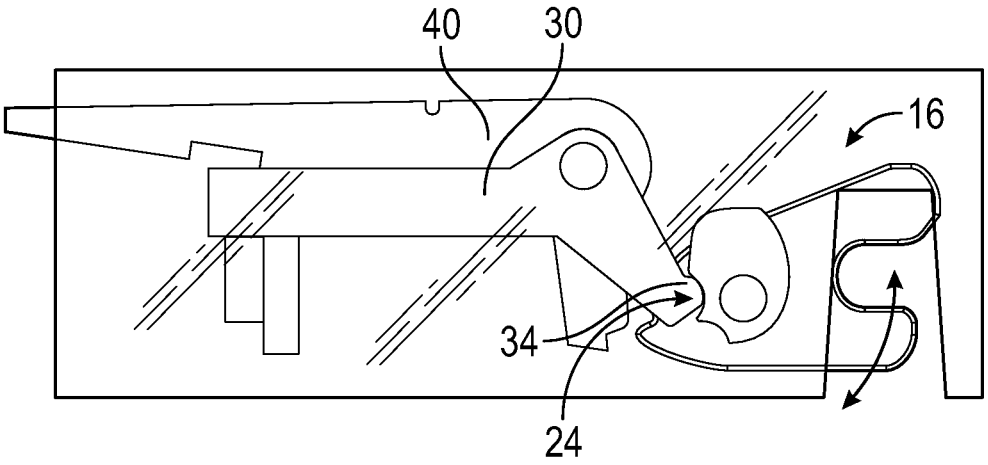
Figure 12A:
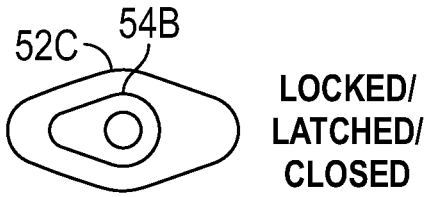
FIGS. 12A-12E depict various configurations of the cam assembly that correspond with the configurations of the locking lever, detent lever, latch, and cam assembly shown in FIGS. 11A-11E according to certain aspects of the present disclosure.
Figure 12B:
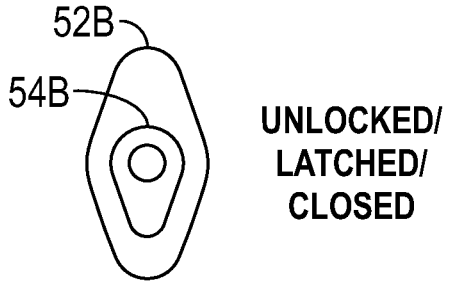

In the "unlocked/latched/closed" configuration of FIG. 11B, which corresponds to the orientation of cam assembly 50 shown in FIG. 12B, the latch 16 is in the closed position but the locking lever 40 has moved to the unlocked position. The detent lever 30 is in the engaged position, thereby holding the latch 16 in the closed position, although the latch 16 can be moved to the open position under the application of at least the certain amount of force as discussed with respect to FIGS. 9A and 9B.

Figure 11C:
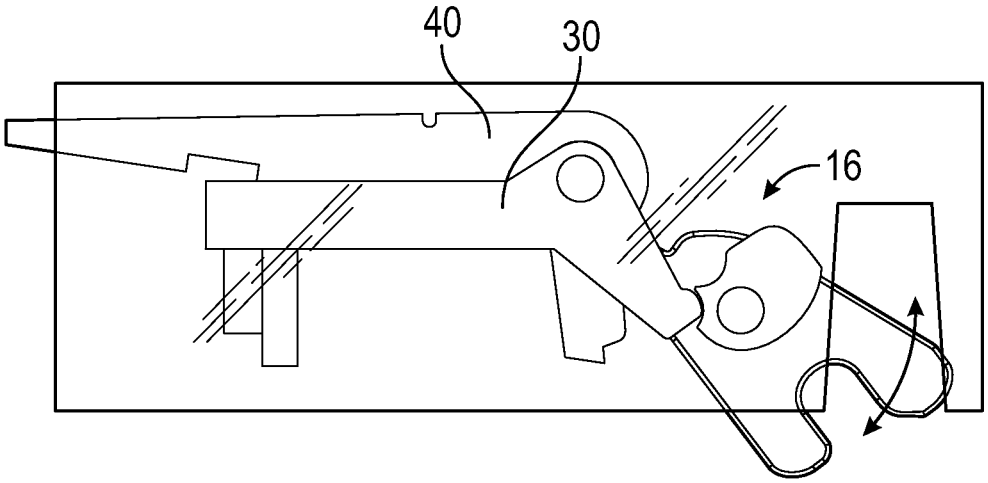
Figure 12C:
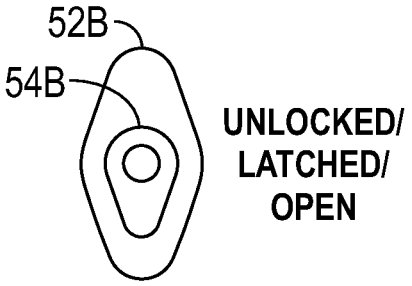

FIG. 11C depicts the same configuration of the locking lever 40 and detent lever 30 as FIG. 11B, which reflects that the orientation of the cam assembly of corresponding FIG. 12C is identical to that of FIG. 12B. FIG. 11C depicts the latch 16 in the open position, and the latch 10 can transition between the configurations of FIGS. 11B and 11C by the application of at least the certain amount of force to latch 16.

Figure 11D:
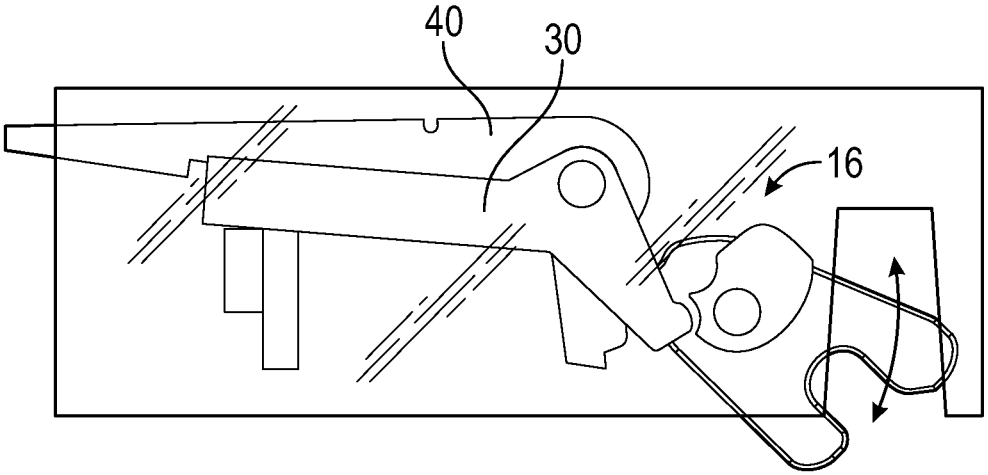
Figure 12D:
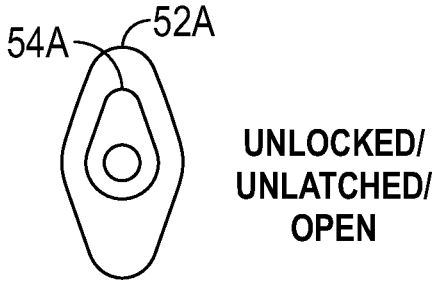

In the "unlocked/unlatched/open" configuration of FIG. 11D, which corresponds to the orientation of cam assembly 50 shown in FIG. 12D, the latch 16 is in the open position with the locking lever 40 is in unlocked position and the detent lever 30 in the disengaged position. Latch 16 can freely move between the closed and open positions, as indicated by the double-ended arrow.

Figure 11E:
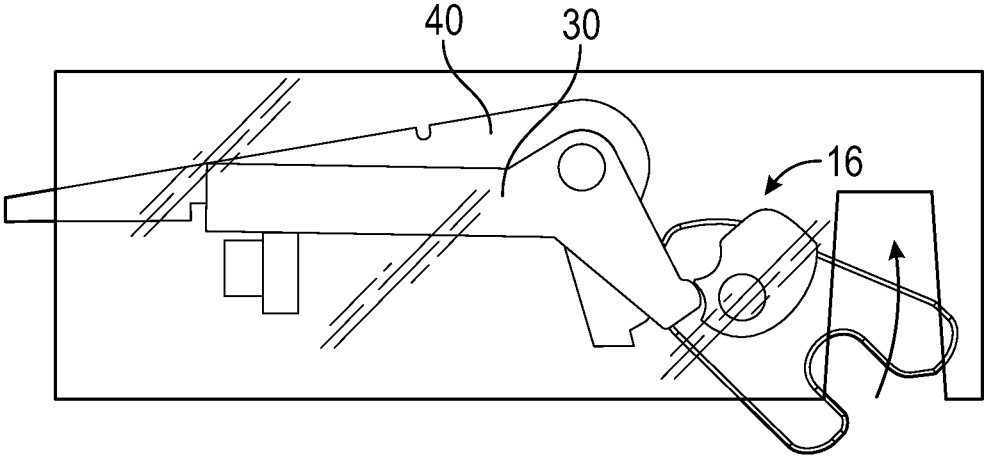
Figure 12E:
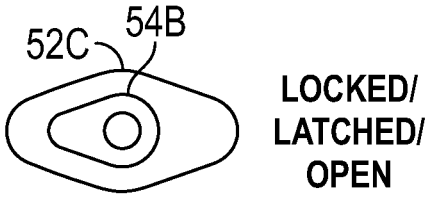

FIG. 11E depicts the configuration of latch 10 when the cam assembly 50 is rotated to the third orientation, shown in FIG. 12E, while the latch 16 is in the open position. The detent lever 30 is engaged and the locking lever 40 is attempting to return to the locked position, as discussed with respect to FIG. 7C. The latch 16 can rotate from the open position to the closed position, as indicated by the single-ended arrow, whereupon the locking lever 40 will engage the notch 26 and retain the latch 16 in the closed position, returning the latch 10 to the configuration of FIG. 11A.

FIGS. 12A-12E depict various configurations of the cam assembly 50 that correspond with the configurations of the locking lever 40, detent lever 30, latch 16, and cam assembly 50 shown in FIGS. 11A-11E according to certain aspects of the present disclosure. It can be seen that the orientation of the cam assembly 50 in FIGS. 12B and 12C are identical, reflecting that the only change between FIGS. 11B and 11C is the position of the latch 16. It can be seen that the configuration of latch assembly 10, and therefore the features of the latch assembly 10 that are enabled at any given time, are controlled by a simple rotation of the cam assembly 50 that is accomplished by the rotation of a single motor 62.

The disclosed examples of a single-actuator latch assembly provide a robust mechanism that provides both a locking capability and a latching capability at a reduced cost with increased reliability. When selectively moved to one of the three disclosed configurations, the latch assembly can (1) lock a moving element in a closed position and, if the moving element is open, capture the moving element when it returns to the closed position, (2) unlock the moving element and allow it to be opened and closed while providing a detent feature, or (3) unlock the moving element and allow it to freely move between and open and closed position. The use of a single actuator to selectively move the latch assembly to one of the three disclosed configurations improves the reliability of the latch assembly by eliminating points of failure, such as a second actuator, and reduces the cost of the complete system by eliminating the need for a lock assembly and a separate detent assembly but also the wiring and mechanical elements associated with the second assembly.

While the disclosed embodiments of the latch are shown with the latch assembly mounted on the stationary element and engage an engagement feature on a moving element, other embodiments of the latch include mounting of the latch assembly on the moving element and provision of the engagement feature on the stationary element. In addition, elements that are shown as single assemblies, for example the cam assembly 50 and the second cam 20 of latch 16, may be provided as separate elements in certain embodiments. Additional elements, for example a spring configured to push the drawer 90 outward when the latch 16 is released, may be provided in certain embodiments.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims.

Reference to an element in the singular is not intended to mean "one and only one" unless specifically so stated, but rather "one or more." Use of the articles "a" and "an" is to be interpreted as equivalent to the phrase "at least one." Unless specifically stated otherwise, the term "some" refers to one or more.

Pronouns in the masculine (e.g., his) include the feminine and neuter gender (e.g., her and its) and vice versa. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "operation for."

Although embodiments of the present disclosure have been described and illustrated in detail, it is to be clearly understood that the same is by way of illustration and example only and is not to be taken by way of limitation, the scope of the present invention being limited only by the terms of the appended claims.

What is claimed is:

1. A latch assembly comprising:

a latch having a closed position and an open position;

a locking lever having a locked position and an unlocked position, the locking lever configured to secure the latch in the closed position when the locking lever is in the locked position;

a detent lever having an engaged position and a disengaged position, the detent lever configured to allow the latch to move between the closed and open positions when the detent lever is in the engaged position;

a first cam rotatable about an axis and comprising a first portion that engages against the locking lever to move the locking lever to the unlocked position, and a second portion that is configured to allow the locking lever to move between the locked and unlocked positions; and a second cam rotatable about the axis with the first cam, the second cam comprising a first portion that engages against the detent lever to move the detent lever to the disengaged position, and a second portion configured to allow the detent lever to move between the engaged and disengaged positions.

2. The latch assembly of claim 1, wherein the first portion of the second cam remains aligned with the first portion of the first cam during rotation of the first and second cam.

3. The latch assembly of claim 1, wherein the locking lever is configured to allow the latch to move from the open position to the closed position when the locking lever is in the locked position.

4. The latch assembly of claim 1, wherein the locking lever is configured to allow the latch to freely move between the closed and open positions when the locking lever is in the unlocked position.

5. The latch assembly of claim 1, wherein the detent lever is configured to allow the latch to freely move between the closed and open positions when the detent lever is in the disengaged position.

6. The latch assembly of claim 1, wherein the locking lever and the detent lever are configured to move independently.

7. The latch assembly of claim 6, further comprising an actuator assembly configured to selectably configure the latch assembly to one of three configurations, wherein:

the locking lever is in the unlocked position and the detent lever is in the disengaged position in a first configuration;

the locking lever is in the unlocked position and the detent lever is allowed to move between the engaged and disengaged positions in a second configuration; and the locking lever is allowed to move between the locked and unlocked positions and the detent lever is allowed to move between the engaged and disengaged positions in a third configuration.

8. The latch assembly of claim 1, further comprising:

a locking spring configured to urge the locking lever toward the locked position; and a detent spring configured to urge the detent lever toward the engaged position.

9. The latch assembly of claim 1, further comprising a latch spring configured to urge the latch toward the open position.

10. A method of operating a latch assembly, comprising:

rotating a first cam and a second cam about a single axis until a first portion of the first cam engages against a locking lever to move the locking lever to an unlocked position, and a first portion of the second cam engages against a detent lever to move the detent lever to a disengaged position, wherein the first portion of the second cam is rotatably aligned with the first portion of the first cam; and rotating the first cam and the second cam about the single axis until a second portion of the first cam permits the locking lever to move between the unlocked position and a locked position, and a second portion of the second cam permits the detent lever to move between the disengaged position and an engaged position;

wherein the locking lever is configured to secure a latch in a closed position when the locking lever is in the locked position, and the detent lever is configured to allow the latch to move between the closed position and an open position when the detent lever is in the engaged position.

11. The method of claim 10, further comprising, permitting the latch to move from the open position to the closed position when the locking lever is in the locked position.

12. The method of claim 10, further comprising, permitting the latch to move between the closed and open positions when the locking lever is in the unlocked position.

13. The method of claim 10, further comprising, permitting the latch to move between the closed and open positions when the detent lever is in the disengaged position.

14. The method of claim 10, further comprising, urging the locking lever toward the locked position using a locking spring.

15. The method of claim 10, further comprising, urging the detent lever toward the engaged position using a detent spring.

16. A latch assembly comprising:

a housing;

a latch coupled to the housing, the latch comprising a first position and a second position;

a locking lever coupled to the housing, the locking lever comprising a locked position and an unlocked position, the locking lever configured to secure the latch in the first position when the locking lever is in the locked position;

a detent lever coupled to the housing, the detent lever comprising an engaged position and a disengaged position, the detent lever configured to allow the latch to move between the first and second positions when the detent lever is in the engaged position;

a cam assembly comprising a first cam and a second cam rotatably aligned about a single axis, the cam assembly rotatable to a first position, a second position, and a third position, the cam assembly configured to:

contact the locking lever with a first cam to move the locking lever to the unlocked position and contact the detent lever with a second cam to move the detent lever to the disengaged position when the cam assembly is in the first position;

contact the locking lever to move the locking lever to the unlocked position and allow the detent lever to move between the engaged and disengaged positions when the cam assembly is in the second position; and allow the locking lever to move between the locked and unlocked positions and allow the detent lever to move between the engaged and disengaged positions when the cam assembly is in the third position; and a single motor coupled between the housing and the cam assembly, the motor configured to selectably move the cam assembly to one of the group of the first position, the second position, and the third position.

17. The latch assembly of claim 16, wherein a latch spring is coupled to the latch, the latch spring configured to urge the latch toward the second position.

18. The latch assembly of claim 16, wherein a locking spring is coupled to the locking lever, the locking spring configured to urge the locking lever toward the locked position.

19. The latch assembly of claim 16, wherein a detent spring is coupled to the detent lever, the detent spring configured to urge the detent lever toward the engaged position.

20. The latch assembly of claim 1, wherein the first cam and the second cam are longitudinally aligned along the axis.

* * * * *